US008206064B2

(12) United States Patent
Mullins et al.

(10) Patent No.: US 8,206,064 B2
(45) Date of Patent: Jun. 26, 2012

(54) VOIDED DRILLED SHAFTS

(75) Inventors: Gray Mullins, Bradenton, FL (US); Kevin Johnson, San Diego, CA (US)

(73) Assignee: University of South Florida, Tampa, FL (US)

( * ) Notice: Subject to any disclaimer, the term of this patent is extended or adjusted under 35 U.S.C. 154(b) by 544 days.

(21) Appl. No.: 11/584,371

(22) Filed: Oct. 20, 2006

(65) Prior Publication Data

US 2007/0092339 A1 Apr. 26, 2007

Related U.S. Application Data

(60) Provisional application No. 60/596,771, filed on Oct. 20, 2005.

(51) Int. Cl.
*E02D 5/30* (2006.01)
*E02D 7/28* (2006.01)

(52) U.S. Cl. ..... 405/239; 405/249; 299/11

(58) Field of Classification Search ..... 405/249; 299/11

See application file for complete search history.

(56) References Cited

U.S. PATENT DOCUMENTS 1,759,626 A * 5/1930 Ockels ..... 52/249
2,074,320 A * 3/1937 Bauer ..... 52/649.6
2,080,406 A * 5/1937 Allen ..... 166/287
3,206,935 A * 9/1965 Phares ..... 405/242
3,257,767 A * 6/1966 Lassy ..... 52/649.8
3,453,831 A * 7/1969 Rusche ..... 405/249
3,471,986 A * 10/1969 Swenson ..... 52/649.8
3,501,920 A * 3/1970 Uchiyama ..... 405/256
3,578,084 A * 5/1971 Bombardieri et al. ..... 166/288
3,842,608 A * 10/1974 Turzillo ..... 405/236
3,924,413 A * 12/1975 Marsh, Jr. ..... 405/251
4,195,487 A * 4/1980 Fukushima ..... 405/257
4,320,992 A * 3/1982 Baldridge et al. ..... 405/223
4,570,409 A * 2/1986 Wilks ..... 52/741.15
4,627,211 A * 12/1986 Foster, Jr. ..... 52/649.7
4,631,892 A * 12/1986 Beck ..... 52/649.4
4,673,157 A * 6/1987 Wells ..... 249/13
4,799,340 A * 1/1989 Lichau et al. ..... 52/170
4,915,544 A * 4/1990 Lin ..... 405/243
5,050,356 A * 9/1991 Johnson et al. ..... 52/295
5,131,790 A * 7/1992 Simpson ..... 405/236
5,320,452 A * 6/1994 Kunito ..... 405/233
5,359,829 A * 11/1994 Voita ..... 52/741.15
5,423,633 A * 6/1995 Verstraeten ..... 405/232
5,505,561 A * 4/1996 Willcox, III ..... 405/251
5,533,835 A * 7/1996 Angelette ..... 405/229
5,542,785 A * 8/1996 Cloud ..... 405/239
5,593,623 A * 1/1997 Mohss ..... 264/32
5,689,927 A * 11/1997 Knight, Sr. ..... 52/297
5,826,387 A * 10/1998 Henderson et al. ..... 52/295

(Continued)

OTHER PUBLICATIONS

Collepardi, M. "A State-of-the-art review on delayed ettringite attack on concrete" *Cem. Conc. Res.*, 2003, pp. 401-407, vol. 25.

(Continued)

*Primary Examiner* — Tara Mayo-Pinnock
(74) *Attorney, Agent, or Firm* — Saliwanchik, Lloyd & Eisenschenk

(57) ABSTRACT

A method of constructing a voided drilled shaft concrete structure is provided. Drilled shafts are large-diameter cast-in-place concrete structures that can generate extremely high temperatures during the concrete hydration/curing phase. The method includes creating an excavation, inserting a cage or an inner casing into the excavation, and filling with concrete the space between the outer surface of the cage or inner surface and the inner surface of the excavation.

1 Claim, 5 Drawing Sheets

U.S. PATENT DOCUMENTS

| | | | | |
|---|---|---|---|---|
| 5,961,253 | A * | 10/1999 | Okawa | 405/239 |
| 6,382,878 | B1 * | 5/2002 | Yang | 405/232 |
| 6,527,481 | B1 * | 3/2003 | Mazzo et al. | 405/231 |
| 6,860,077 | B2 * | 3/2005 | Yin | 52/649.4 |
| 7,493,735 | B2 * | 2/2009 | Yin | 52/649.4 |
| 2004/0037653 | A1 * | 2/2004 | Kelso | 405/236 |
| 2004/0202511 | A1 * | 10/2004 | Bae | 405/257 |
| 2007/0166111 | A1 * | 7/2007 | Knepp et al. | 405/249 |

OTHER PUBLICATIONS

Stark, J. and Bollman, K. "Delayed ettringite formation in concrete" *Nordic Concrete Research*, http://www.itn.is/ncr/publications/pub-23.pdf, 1998, vol. 23, No. 2.

U.S. Department of Interior "Story of Hoover Dam; Concrete" *Bureau of Reclamation*, http://www.usbr.gov/lc/hooverdam/History/essays/concrete.html, 2004.

* cited by examiner

VOIDED DRILLED SHAFTS

CROSS-REFERENCE TO RELATED APPLICATION(S)

The present application claims the benefit of U.S. Provisional Application Ser. No. 60/596,771, filed Oct. 20, 2005, which is hereby incorporated by reference herein in its entirety, including any figures, tables, or drawings.

This work was supported in part from Grant 2104102800 from the Florida Department of Transportation.

BACKGROUND OF INVENTION

Large concrete structures using drilled shaft foundations are often cast in place. In some cases these foundation elements have been constructed without considering mass concrete effects and the possible long-term implications of the concrete integrity. Such considerations address the extremely high internal temperatures that can be generated during the concrete hydration/curing phase. The extremely high internal temperatures can be detrimental to the shaft durability and/or integrity in two ways: (1) short-term differential temperature-induced stresses that crack the concrete and (2) long-term degradation via prolonged excessively high temperatures while curing.

Mass concrete is generally considered to be any concrete element that develops differential temperatures between the innermost core and the outer surface, which can develop tension cracks due to the differential temperatures. Some state departments of transportation (DOTs) have defined geometric guidelines that identify potential mass concrete conditions as well as limits on the differential temperature experienced. For instance, the Florida DOT designated any concrete element with minimum dimension exceeding 0.91 m (3 ft) and a volume to surface area ratio greater than 0.3 $m^3/m^2$ will require precautionary measures to control temperature-induced cracking (FDOT, 2006). The same specifications set the maximum differential temperature to be 20° C. (35° F.) to control the potential for cracking. For drilled shafts, however, any element with diameter greater than 1.83 m (6 ft) is considered a mass concrete element despite the relatively high volume to area ratio.

The latter of the two integrity issues, i.e., excess high temperature, is presently under investigation at a number of institutions. When concrete temperature exceeds safe limits on the order of 65° C. (150° F.), the concrete may not cure correctly and can ultimately degrade via latent expansive reactions termed delayed ettringite formation (DEF). This reaction may lay dormant for several years before occurring; or the expansion may not occur as it depends on numerous variables involving the concrete constituent properties and environment.

Accordingly, there is a need for providing cast-in-place foundation structures that can reduce or eliminate durability and integrity issues associated with excess high temperatures.

BRIEF SUMMARY

This invention addresses a construction-related issue that arises when large concrete structures (specifically drilled shaft foundations) are cast-in-place and where the temperature caused by the heat of hydration cannot be easily maintained below safe limits. The concept is likely to benefit Local, State, and Federal agencies (both domestic and abroad) that use such large diameter deep foundations by eliminating the need for integrated concrete cooling systems/ piping. Consequently, a cost savings is probable due to reducing the volume of required concrete to cast such foundation as well as removing the need for cooling systems.

Accordingly, there is provided a method for constructing a drilled shaft foundation incorporating a voided drilled shaft.

BRIEF DESCRIPTION OF DRAWINGS

FIG. 3B shows an embodiment of a detail shown in FIG. 3A.

DETAILED DISCLOSURE

Drilled shafts are large-diameter cast-in-place concrete structures that can develop enormous axial and lateral capacity. Consequently, these large-diameter cast-in-place concrete structures are the foundation of choice for many large bridges subject to extreme event loads such as vessel collisions. However, during their construction they can generate extremely high internal temperatures during the concrete hydration/curing phase. When this temperature exceeds safe limits, the concrete does not cure correctly and will ultimately degrade via delayed ettringite formation (DEF). Minimizing the peak temperature (and the associated defects) can be undertaken by casting the shafts without concrete in the core thereby removing a large amount of the energy producing material in a region that is least likely to benefit the structural capacity and that is less able to dissipate the associated core temperatures due to the presence of the more peripheral concrete.

Construction Considerations

Figure 1:
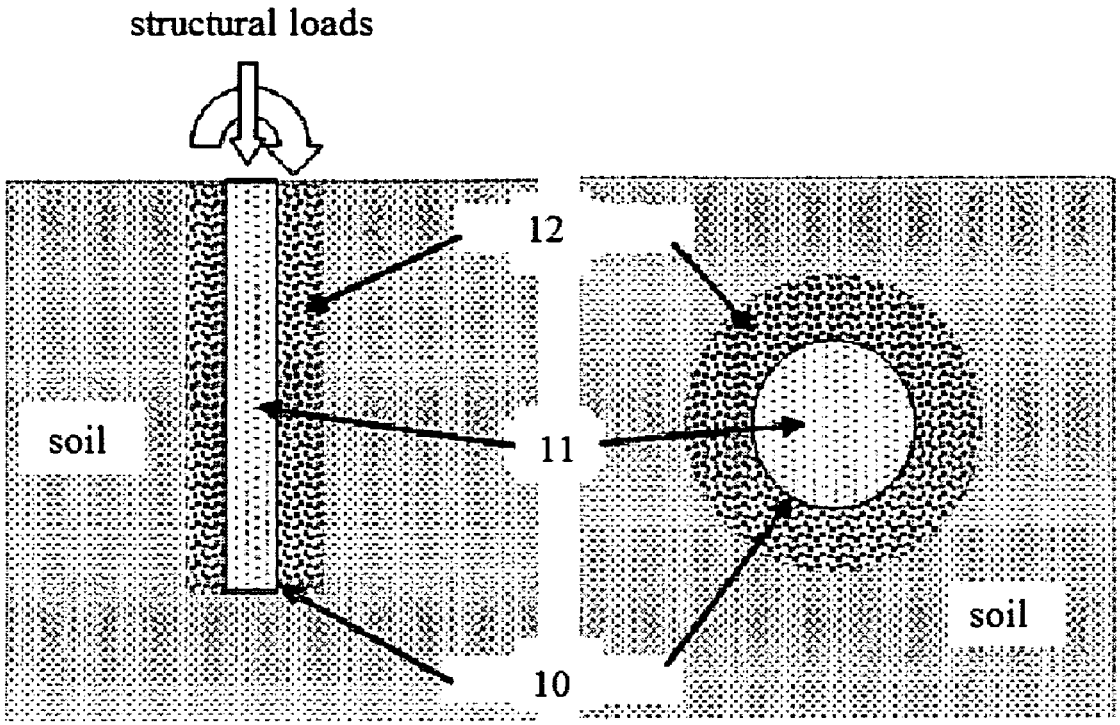
FIG. 1 is a conceptual schematic of a voided shaft.

Construction of drilled shafts can involve excavating a hole deep into the ground. In one embodiment, the excavating can be accomplished using rotary type augers (hence the name drilled). Then, construction continues by inserting reinforcing steel into the excavation in the form of a cylindrical cage, and filling the hole with wet/liquid concrete which occupies the space from which the soil was excavated. Constructing a shaft with a central void can involve normal excavation of the shaft's outer diameter followed by the insertion of a centralized steel casing (or similar) that can adequately seal below the bottom of the outer shaft diameter. FIG. 1 shows a conceptual schematic of an embodiment of a voided drilled shaft. Referring to FIG. 1, a drilled shaft can incorporate a steel casing 10 forming a void 11 surrounded by shaft concrete 12. In one embodiment, for a 2.75 m shaft, the void 11 can have a diameter of between 1 m to 1.22 m. In another embodiment, for a 2.75 m shaft, the void 11 can have a diameter of 1.22 m. In another embodiment, for a 2.75 m shaft, the void 11 can have a diameter of between 1.22 m to 2.5 m. In yet another embodiment, for a 2.75 m shaft, the void 11 can have a diameter of 2.5 m.

Alternate methods of construction may include, but are not limited to: filling the inner casing into the soil beneath the prescribed bottom elevation such that sufficient side shear would resist additional buoyancy caused by concreting, and/or capping the bottom of the inner casing to provide additional isolation between the central and annular cavities prior to and during concreting. In one embodiment, concrete placement can be carried out with a pump truck which provides the capability of easily moving the tremie (hose) during concreting to unify the concrete flow levels around the inner casing.

Concrete placement can be carried out with any method provided it can be easily moved during concreting to unify the concrete flow levels around the inner casing. Use of new high performance shaft concrete would certainly be advantageous.

Figure 2A:
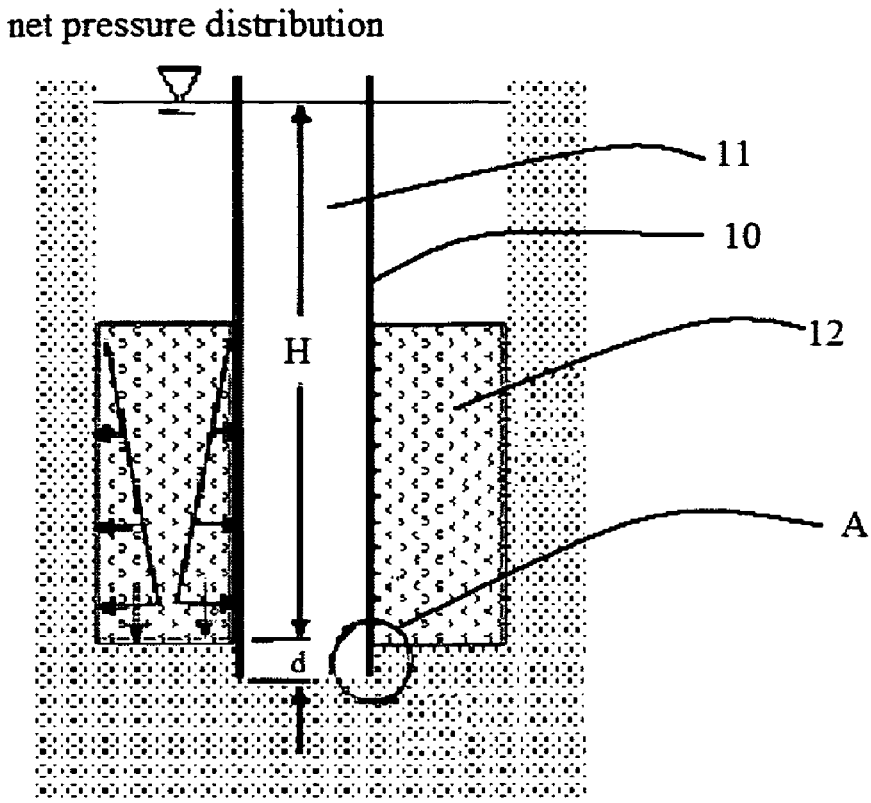
FIGS. 2A and 2B show a schematic reflecting hydrostatic pressure distribution.
Figure 2B:
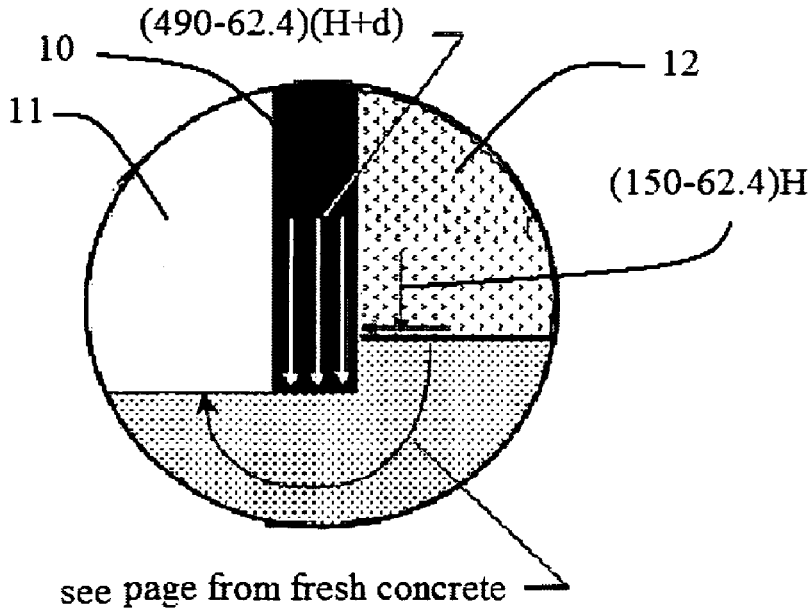

Inner casing installation, alignment, and overcoming potential buoyancy forces are perhaps the most significant obstacles to constructing voided shafts. The physics of buoyancy forces provide a problem if the concrete can form a pressure face beneath the casing causing an upward force. FIGS. 2A and 2B show a net hydrostatic pressure distribution during construction. Lateral concrete pressure will not induce buoyancy but rather will require sufficient casing stiffness such that it will not collapse. In open ended casing, as there is little surface area on which upward pressure could act, the real issue is assuring concrete will not flow underneath and fill the inner casing. Therefore, the casing should form a seal with the bottom of the excavation in spite of the upward drag force that accompanies concreting.

One method of sealing the casing is socketing it beneath the toe of the voided shaft. This socket is not required to develop significant side shear with the inner casing but should provide a reasonable seal. Advancing the inner casing into the underlying strata can be performed by duplex drilling (drilling beneath the casing while advancing), vibratory, or oscillatory installation. When slurry stabilization is to be used, duplex drilling would likely be preferred. In embodiments, cuttings would not need to be removed (or at least not completely) from the inner casing during its installation, nor would it be necessary to perform clean-out processes within the inner casing. When full length temporary casing is employed to stabilize the hole, duplex, vibratory, oscillatory, or a combination installation method would suffice to install the inner casing.

Figure 3A:
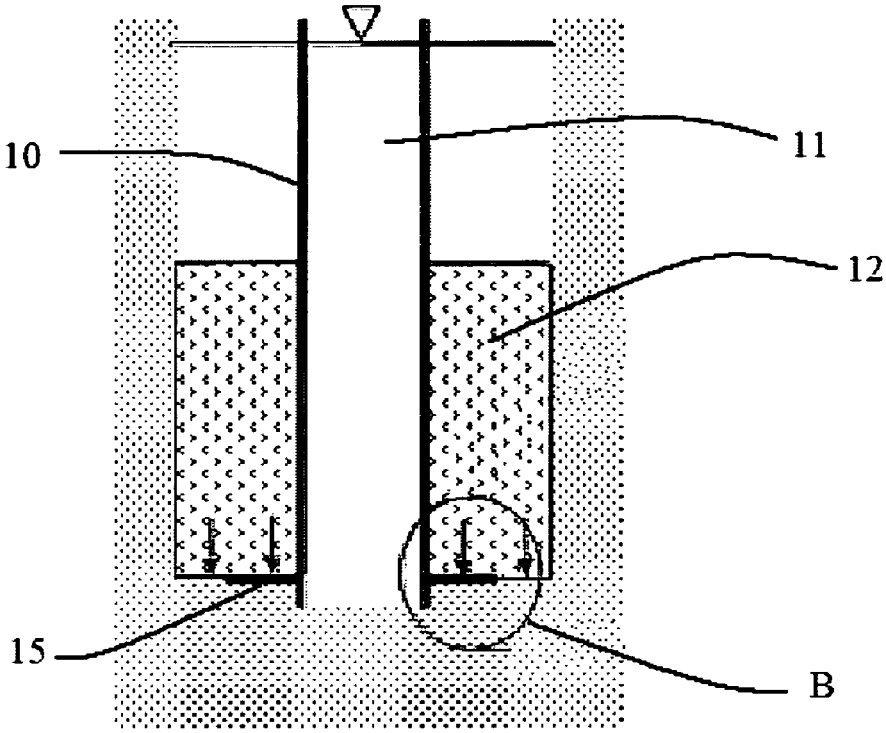
FIGS. 3A and 3B show a schematic of a voided shaft according to an embodiment of the subject invention incorporating a flange.
Figure 3B:
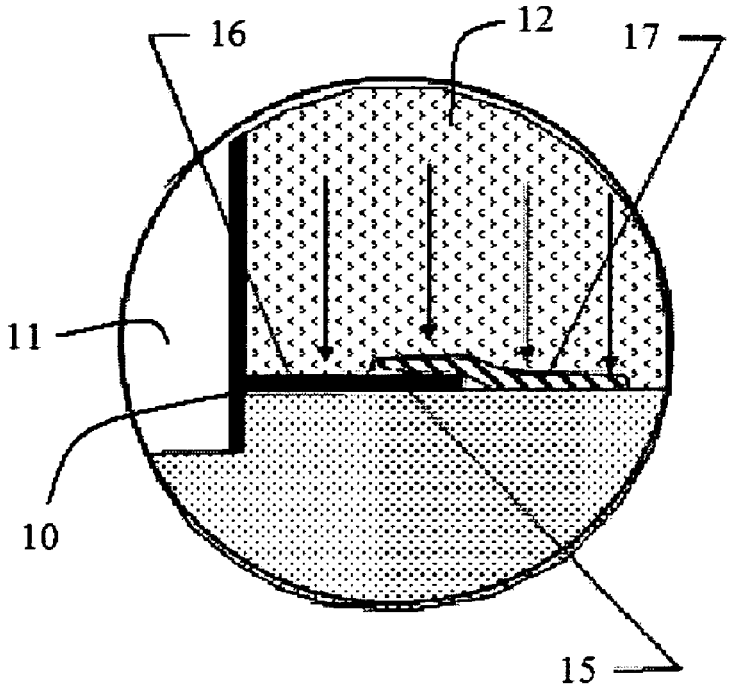

Referring to FIGS. 3A and 3B, one method of providing a seal between the inner casing and the excavation bottom can include a flange 15 at the base of the casing that would both center the casing at the toe and provide a flat surface on which the self weight of the shaft concrete would secure the seal. In an embodiment, the flange can be rigid, flexible, or a combination thereof. FIG. 3B shows an embodiment of a combination rigid flange 16 and flexible flange 17. A combination of flange and socketing may be found most suitable in certain circumstances.

Figure 4A:
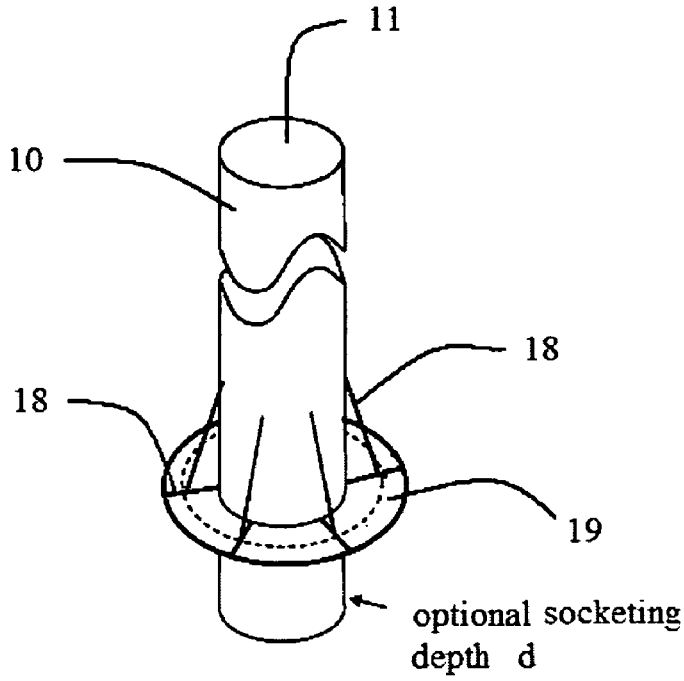
FIGS. 4A and 4B show schematics of a voided shaft incorporating a casing and reinforcement framework according to embodiments of the subject invention.
Figure 4B:
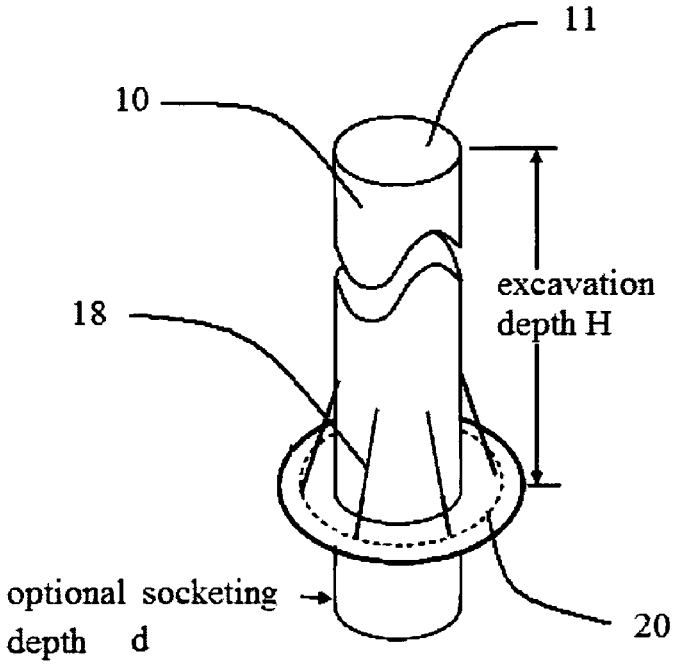

Centering the inner casing as well as the reinforcement cage is also important and can be achieved by attaching a framework to the inner casing. The framework can be simple. For example, the framework can be a reinforcement cage centralized by struts. FIGS. 4A and 4B show embodiments of a centralizing framework. Referring to FIG. 4A, steel struts 18 can be welded to the casing 10 and a centralizing framework 19. Referring to FIG. 4B, in another embodiment, the steel struts 18 can be welded to the casing 10 and a centralizing/sealing flange assembly 20. If a flange assembly is used, the frame work can be extended from and/or incorporated into the flange. Struts can be attached to this frame to provide the necessary stiffness and serve a dual purpose by providing cage centering via properly dimensioning their connection locations. This can provide better assurance of the cage placement than the presently used plastic spacers which often are found floating to the top during concreting.

Strength Considerations

According to calculations, strength reduction caused by the reduced cross-sectional area is likely to have little effect on the structural performance of the foundation element because the soil resistance is typically the limiting parameter being on the order of 3 to 5 times weaker than the concrete shaft. Therein, the geotechnical capacity would only be affected via the reduction in the end bearing area which is not typically considered a significant capacity contributor in large diameter shafts. However, in one embodiment, this capacity can be regained by initially plugging or plating the inner casing.

Structurally, a 9 ft diameter shaft with a 4 ft diameter central void would exhibit a reduction in axial capacity roughly proportional to the loss in cross-sectional area in the range of 19% which would still be far stronger than the 65% to 80% strength loss required to be problematic (or required to equal the soil resistance). Lateral loads and overturning moments which induce bending of the concrete section, and can produce far more severe stresses, would only be mildly affected by the presence of the void with a reduction in the moment envelope bending resistance of 6%. This is due to the minimal contribution to the moment of inertia and the associated bending strength provided by the more centrally located concrete material. Further, the 6% reduction does not consider the gain in bending capacity associated with the inner steel casing if permanent.

Cost Effectiveness

Figure 5:
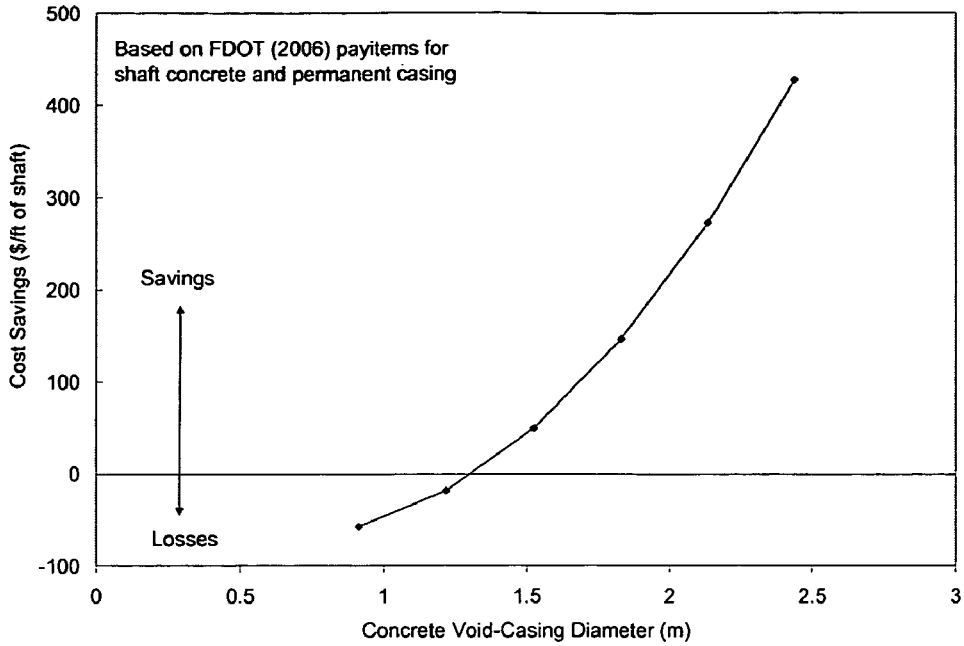
FIG. 5 is a graph comparing cost savings from permanently placed steel casings versus the displaced core concrete.

Preliminary cost comparisons between the permanent steel casing required to maintain the void during concreting and the central concrete that would be displaced (not required) shows that the concept can be cost effective even without the savings associated with the now un-necessary cooling system. FIG. 5 shows that for void diameters greater than about 4 ft the cost savings from concrete not used offsets the cost of the steel casing. This assumes that the casing is permanent and no innovative method of inner form-work extraction has been devised.

In many embodiments, an annular thickness of 2.5 ft is envisioned to be the practical lower limit for construction. This leaves approximately 2 ft between the inner casing and the reinforcement cage for a pump truck hose to negotiate the concrete placement process. As a result, the FIG. 5 results show a break even in cost. However, the real cost benefit comes from no cooling system requirement and the assurance of long-term durability.

Curing Temperature Maintenance

Figure 6:
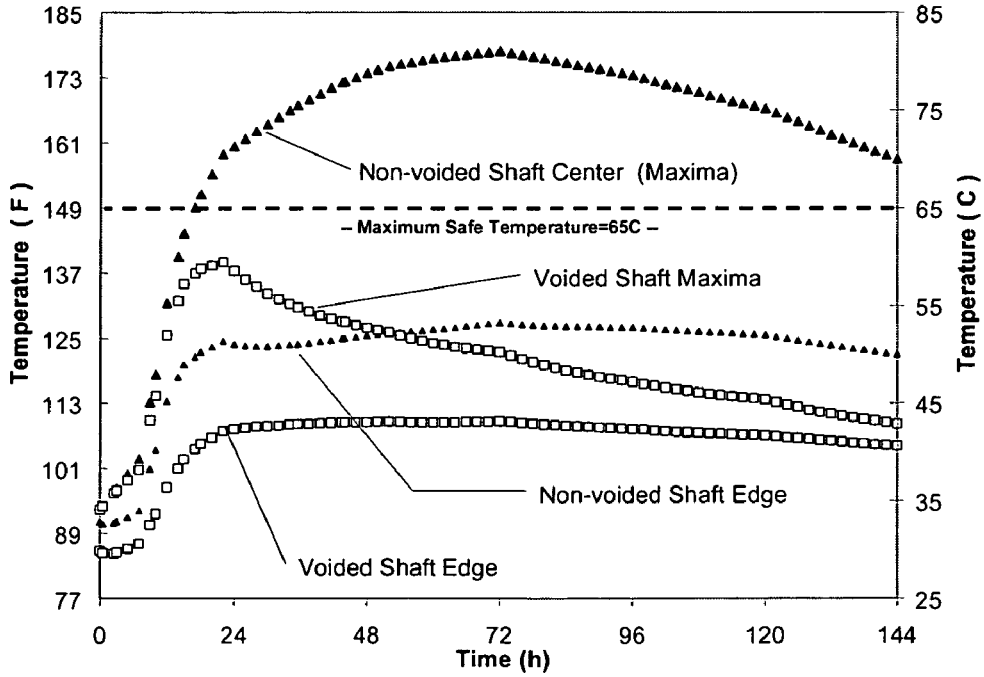
FIG. 6 is a graph illustrating numerical modeling reflecting a reduction in the peak concrete temperature as a result of voiding.

The numerically modeled temperature responses of a 9 ft (2.75 m) diameter shaft with and without a 4 ft (1.22 m) diameter void according to an embodiment of the subject invention are shown in FIG. 6. The accuracy of the model has been verified with field data that supports the un-voided shaft's temperature response.

Referring to FIG. 6, note that under those conditions the peak temperature increase in the un-voided shaft is related to the difference in ambient temperature and the lack of thermal convection in saturated soil. The voided shaft was modeled with the void (center of casing) filled with slurry which in turn attained the same peak temperature. This was well less than the recommended safe temperature, and temperature differentials momentarily approach but do not exceed 20° C. Recent unpublished results, using published cement heat parameters, also indicate that supplanting 50% cement with ground granulated blast furnace slag does not diminish either peak or differential temperatures in large diameter shafts, but increases the centroidal peak time lag.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

What is claimed is:

1. A method of constructing a drilled shaft voided concrete column, comprising:

excavating a shaft having an outer diameter;

inserting an inner casing;

centering the inner casing by providing a centering framework attached to the inner casing, wherein the centering framework comprises a reinforcement cage formed of a sealing flange assembly attached to the inner casing by struts welded to the inner casing and the sealing flange; and filling the shaft with concrete between an outer surface of the inner casing and the outer diameter of the shaft.

* * * * *